US005937460A

United States Patent [19]

Humphries

[11] Patent Number: 5,937,460

[45] **Date of Patent: *Aug. 17, 1999**

[54] CERVICAL PILLOW HAVING ADJUSTABLE HEIGHT AND SIDE CUSHIONS

[76] Inventor: Bruce A. Humphries, 10237 Feldspar, Mentone, Calif. 92359

[ * ] Notice: This patent issued on a continued prosecution application filed under 37 CFR 1.53(d), and is subject to the twenty year patent term provisions of 35 U.S.C. 154(a)(2).

[21] Appl. No.: 08/885,200

[22] Filed: Jun. 30, 1997

[51] Int. Cl.[6] ..... A47C 20/00

[52] U.S. Cl. ..... 5/640; 5/636; 5/637; 5/643; 5/645

[58] Field of Search ..... 5/640, 636, 637, 5/622, 643, 645; D6/601

[56] References Cited

U.S. PATENT DOCUMENTS

| | | | |
|---|---|---|---|
| D. 203,251 | 12/1965 | Barber | 5/363 |
| 2,880,428 | 4/1959 | Forsland | 5/636 |
| 3,243,828 | 4/1966 | McCarty | 5/636 |
| 4,916,765 | 4/1990 | Castronovo | 5/640 |
| 5,533,218 | 7/1996 | Fahy | 5/636 |
| 5,682,633 | 11/1997 | Davis | 5/636 |

*Primary Examiner*—Michael F. Trettel
*Assistant Examiner*—Fredrick Conley
*Attorney, Agent, or Firm*—Leonard Tachner

[57] ABSTRACT

A proper height pillow for both upward and side-facing head positions. It comprises a base pillow having a unique adjustability feature wherein the height of the neck support region may be selectively increased by the addition of at least one further cushion within a slotted receptacle within that region. Moreover, the present invention comprises a pair of side posture support cushions which are preferably attached loosely to the base pillow along the lateral margins thereof. The side posture support cushions provide proper support for both the head and neck of a side-facing user. The attachment of the cushion to the base pillow permits the user to either position the side cushions on the base pillow for side posture support (while still allowing access to the underlying base pillow between the side cushions) or position the side cushions off the base pillow to permit access to the entire base pillow surface without encountering the side cushions. The thickness of the side cushions may also be varied in the present invention.

5 Claims, 4 Drawing Sheets

CERVICAL PILLOW HAVING ADJUSTABLE HEIGHT AND SIDE CUSHIONS

BACKGROUND OF THE INVENTION

1. Field of the Invention

The present invention relates generally to the field of cervical pillows designed to provide support for both head and neck. The invention relates more specifically to a cervical pillow having height adjustment and moveable side cushions, the latter providing improved neck support for the side-facing head.

2. Prior Art

Conventional pillows provide some form of support for the head, but little or no support for the neck particularly when the user is in a side-facing position. Even the extent of head support is tenuous because it depends on the firmness and height of the pillow. There are numerous allegedly orthopedic pillows wherein the firmness, shape and contour of the pillow are supposed to more properly support the head and neck. However, such prior art orthopedic pillows tend to be insufficient in height particularly for a side-facing head position and thus still do not properly support the neck.

SUMMARY OF THE INVENTION

The present invention provides a proper height pillow for both upward and side-facing head positions. It comprises a fairly conventional orthopedic base pillow having a unique adjustability feature wherein the height of the neck support region may be selectively increased by the addition of at least one further cushion within a slotted receptacle within that region. Moreover, the present invention comprises a pair of side posture support cushions which are preferably attached loosely to the base pillow along the lateral margins thereof. The side posture support cushions provide proper support for both the head and neck of a side-facing user. The attachment of the cushion to the base pillow permits the user to either position the side cushions on the base pillow for side posture support (while still allowing access to the underlying base pillow between the side cushions) or position the side cushions off of the base pillow to permit access to the entire base pillow surface without encountering the side cushions. The thickness of the side cushions may also be varied in the present invention. Thus, the invention provides increased comfort and support for the head and neck as compared to prior art orthopedic pillows and also provides a number of adjustability features which are unique and highly advantageous.

OBJECTS OF THE INVENTION

Thus it is a principal object of the present invention to provide an orthopedic pillow having height adjustability.

It is another object of the invention to provide an orthopedic pillow having special support cushions for side-facing posture.

It is still another object of the invention to provide an orthopedic pillow comprising a base pillow for support of the head and neck in the supine position and at least one side cushion for support of the head and neck in the side-facing position.

It is yet another object of the invention to provide an orthopedic pillow wherein a base pillow has a pair of spaced side cushions rotatably attached to the respective lateral margins of the base pillow to permit selective positioning of the side cushions either on or off the base pillow.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
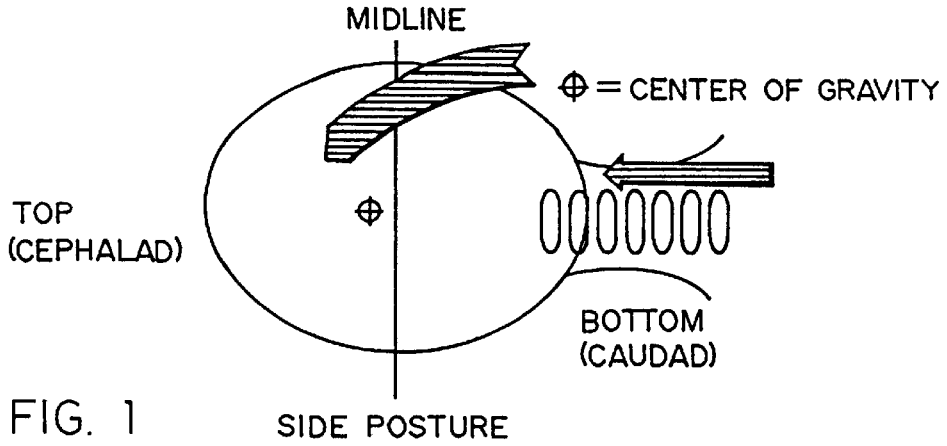
FIG. 1 is a simplified illustration of a side-facing head and neck.
Figure 2:
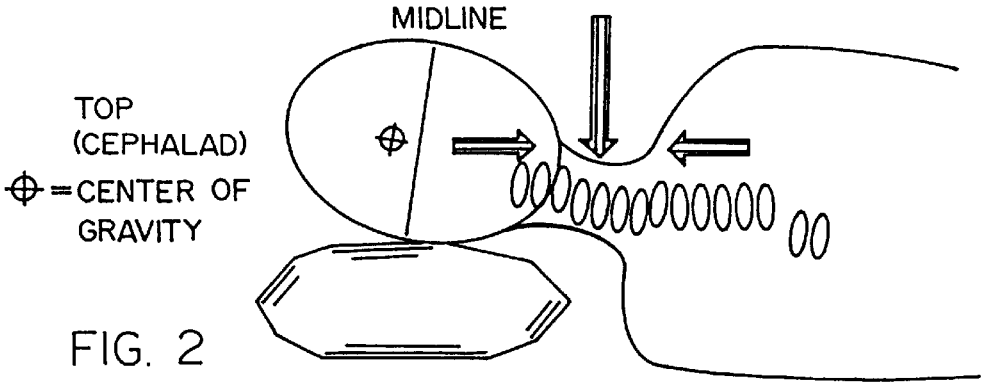
FIG. 2 is a simplified illustration of a side-facing head and neck on a conventional pillow.
Figure 3:
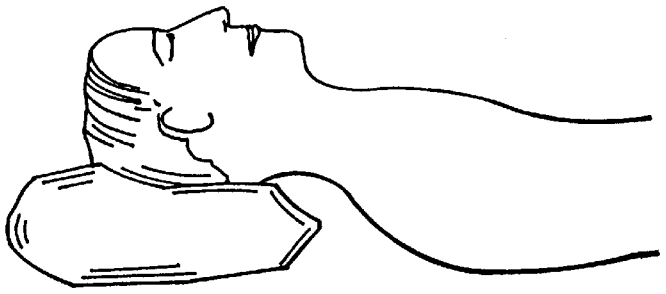
FIG. 3 is a simplified illustration of a conventional pillow supporting a user in a supine position.

As shown in FIG. 1, the center of gravity for the adult human head in a side-facing posture is approximately just above (toward scalp) the mid-line. The lower head structures (jaw, oral and nasal cavities) make the lower head lighter and thus locating the center of gravity higher than mid-line which causes the head and neck to pivot in the direction of the arrow shown in FIG. 1. Because the head is tethered to the neck, rotation of the head as shown causes vertebra of the neck to move into an aligned position under some mild tension. However, without underlying support of the neck, the effect of gravity in the side-facing position causes the vertebra to sag as shown in FIG. 2. FIG. 2 illustrates the use of a conventional pillow (i.e., not orthopedic) in a side-facing position. Clearly, there is no neck support in this position on a conventional pillow. FIG. 3 illustrates the use of a conventional pillow for a user in a supine position. It is apparent that even in this position, there may be no support for the neck, resulting in strain of the cervical area including vertebra, muscles, tendons, ligaments and nerve tissue.

Figure 4:
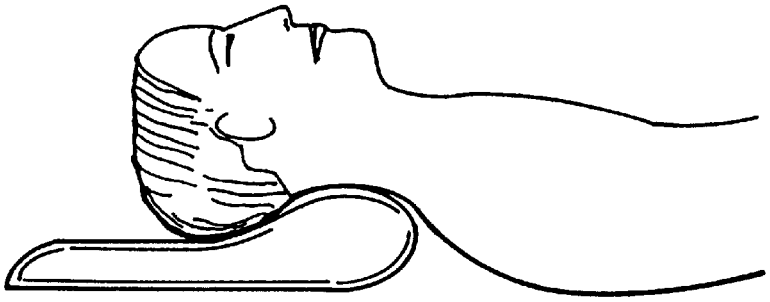
FIG. 4 is a simplified illustration of an orthopedic pillow with sufficient height to support the head and neck in the supine position.
Figure 5:
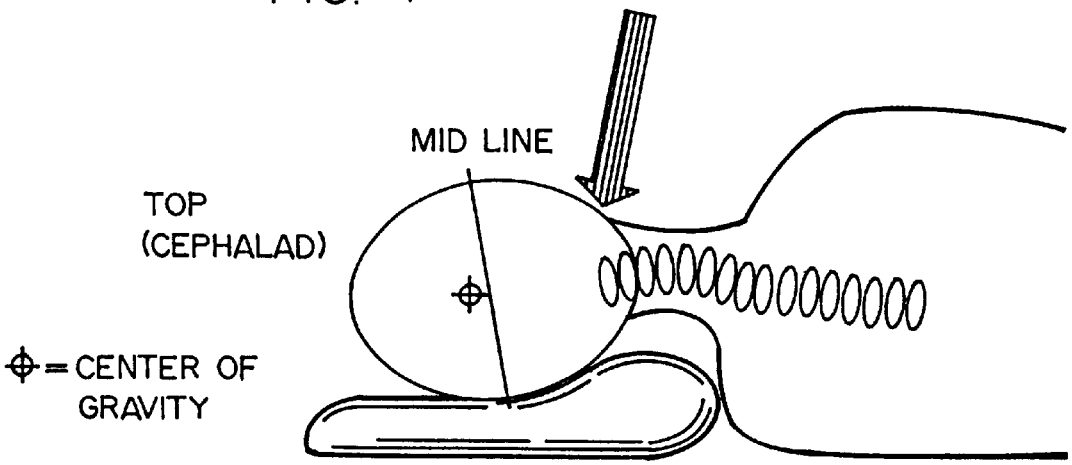
FIG. 5 (PRIOR ART)
FIG. 5 is a simplified illustration of a prior art orthopedic pillow supporting a user's head but not a user's neck when the user is in a side-facing position.

FIG. 4 shows a user in a supine position on a prior art orthopedic pillow. Although the neck region appears well-supported, it will be apparent that the height of the pillow contours is critical in providing proper support and that the size of the head and neck (as well as the adjacent upper body structure) may not permit one size pillow to accommodate every adult user. Furthermore, as seen in FIG. 5, even an orthopedic pillow does not properly support the neck for a user in a side-facing position.

Figure 6:
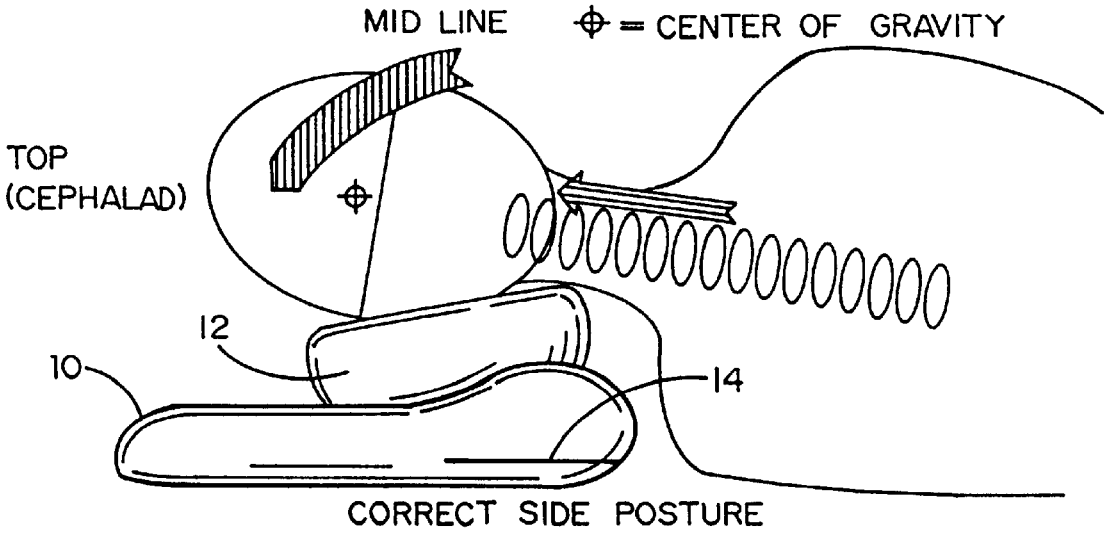
FIG. 6 is a simplified illustration of the inventive orthopedic pillow properly supporting the user's head and neck.
Figure 7:
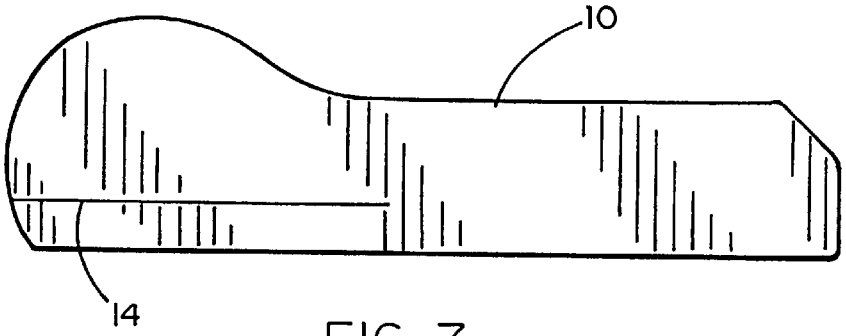
FIG. 7 is a side view of the base pillow of the invention.
Figure 9:
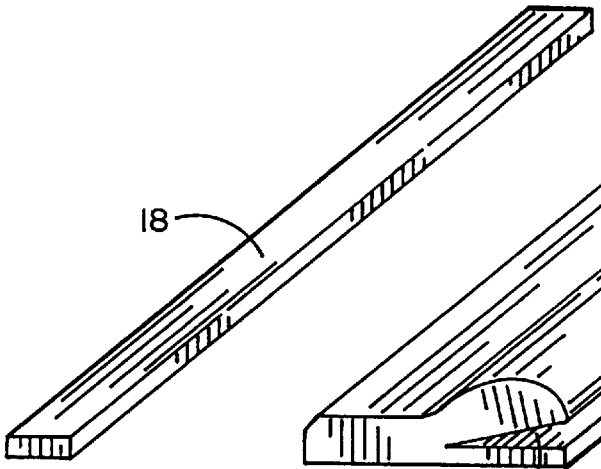
FIG. 9 is a three-dimensional view of a height insert for the base pillow.
Figure 8:
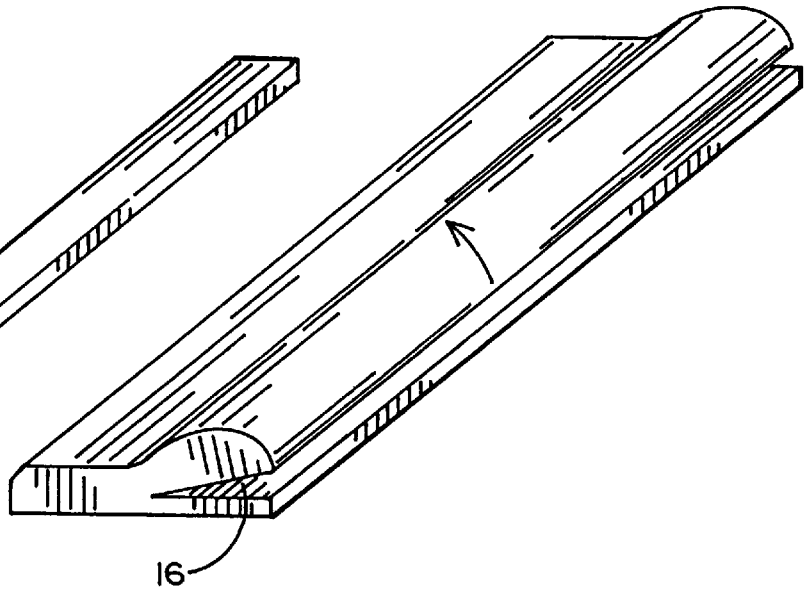
FIG. 8 is a three-dimensional view of the base pillow.

The present invention may be best understood by referring to FIGS. 6–11. The invention comprises a base pillow 10 and at least one and preferably two side cushions 12. As shown in FIG. 6, the side cushions 12 significantly raise the head in the side-facing position while also supporting the neck region. The result is a straight, non-sagging cervical area which provides the proper alignment of the vertebra and avoids the discomfort causing tension encountered in the neck region using conventional or prior art orthopedic pillows. Moreover, the present invention uniquely permits height adjustment of the contoured region of the base pillow 12. As seen in FIGS. 7–9, the base pillow is provided with an elongated slit 14 which may be rotated upwardly. The elevated portion of the base pillow 12, exposes a surface 16 into which one or more cushion inserts 18 may be inserted to raise the level of the support region of the base pillow. Thus, the present invention provides adjustment for different degrees of height positioning thereby accommodating a larger variation in head and neck anatomy.

Figure 10:
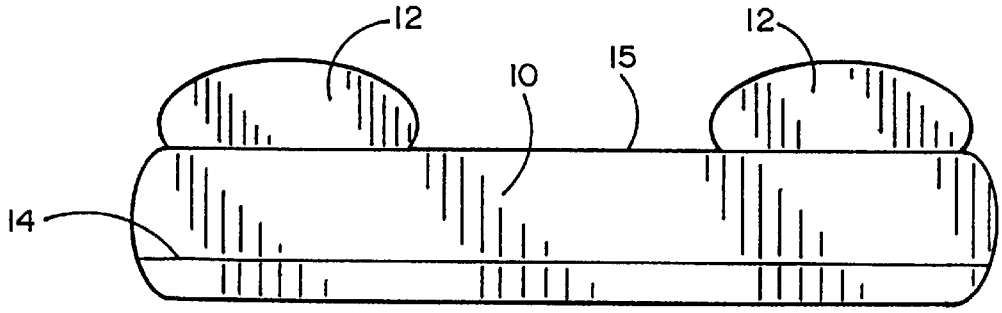
FIG. 10 is an elevational view of the invention showing the side support cushions in their deployed position.
Figure 11:
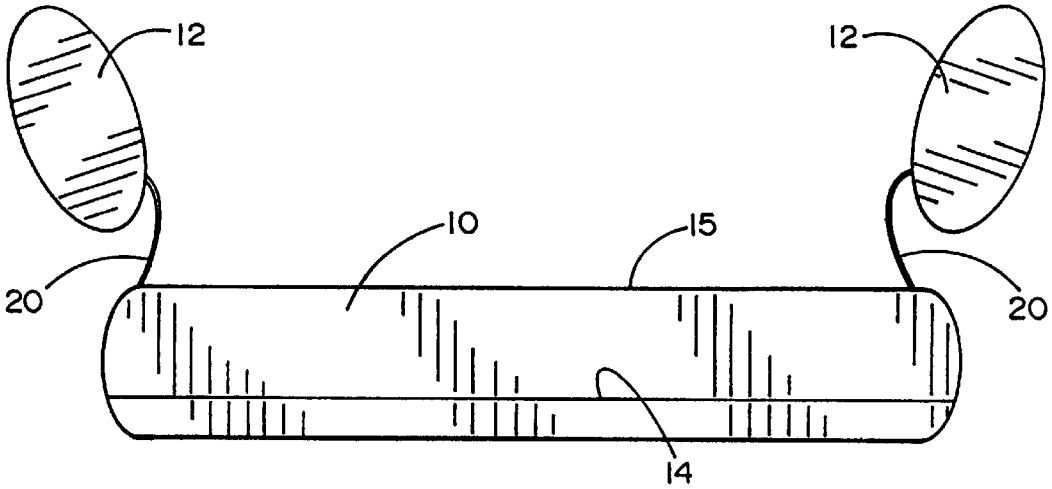
FIG. 11 is an elevational view of the invention similar to FIG. 10, but showing the side support cushions in their transition to a non-deployed position.

As shown in FIGS. 10 and 11, the present invention, in a preferred embodiment, provides two, spaced apart cushions 12 while leaving a central base pillow surface 15 for the supine position of a user.

A significant feature of the preferred embodiment results from the manner in which the side cushions 12 are secured to the base pillow 10. More specifically, as shown in FIG. 11, the side cushions are preferably secured by fabric connections 20 to the lateral edges of the base pillow. As a result, the side cushions may be articulated or rotated off the surface 15, thereby providing access to the entire length of the pillow surface. Moreover, the relative freedom of movement of the side cushions 12 relative to the surface 15 of the base pillow 10, permits tilling of the side cushions to provide the user with additional adjustment and thus increased comfort for a user in the side-facing position.

The height of the side cushions is also selectable. As seen in FIGS. 10 and 11, the side cushion 12 on the left is thicker than the side cushion 12 on the right. Furthermore, the side cushions may be contained in an accessible sack which is large enough to hold more than one such cushion. In this way, the side cushions may be adapted to be small, medium or large (in height), depending upon the thickness of and number of cushions used. Thus, the present invention provides height adjustment of the base pillow and height adjustment of the side cushions, as well as the ability to accommodate proper supine and side-facing support of head and neck structure.

Having thus described a preferred embodiment of the invention, it being understood the described example is illustrative and not necessarily limiting of the scope of protection, what I claim is:

1. An orthopedic pillow comprising:

(a) a base pillow extending in a longitudinal direction, said base pillow forming a substantially planar surface and a contoured surface forming a backwall of said base pillow, said contoured surface being contoured uniformly and in a plane perpendicular to said longitudinal direction throughout an extension length of said base pillow in said longitudinal direction, said base pillow having an inclined longitudinally directed slot formed through said contoured surface and extending throughout said extension length of said base pillow, said inclined slot extending in a transverse direction through said backwall; and, (b) at least one longitudinally directed insert member for insert into said inclined slot for selectively adjusting the height of said contoured surface without affecting the height of said planar surface.

2. The orthopedic pillow as recited in claim 1 including at least one side cushion connected to said base pillow for removably positioning said side cushion on said contoured surface on at least one end section of said base pillow.

3. The orthopedic pillow as recited in claim 2 where said side cushion is tethered to an end section of said base pillow.

4. The orthopedic pillow as recited in claim 1 including a pair of spaced apart side cushions connected to said base pillow on opposing longitudinal end sections for removably positioning said side cushions on said contoured surface at said opposing longitudinal end sections.

5. The orthopedic pillow as recited in claim 4 where each of said cushions are tethered to respective end sections of said base pillow for articulated motion of said side cushions relative to said respective end sections.

* * * * *